United States Patent [19]

Persson

[11] 4,305,447

[45] Dec. 15, 1981

[54] SHADE ROLLER LATCH

[76] Inventor: Bo S. O. Persson, P1 4540 Dragsnäs, S-372 00 Ronneby, Sweden

[21] Appl. No.: 85,236

[22] Filed: Oct. 16, 1979

[30] Foreign Application Priority Data

Oct. 17, 1978 [SE] Sweden ..... 7810802

[51] Int. Cl.[3] ..... E06B 9/20

[52] U.S. Cl. ..... 160/297

[58] Field of Search ..... 160/297; 188/82.84; 192/45, 46

[56] References Cited

U.S. PATENT DOCUMENTS

| | | | |
|---|---|---|---|
| 1,019,653 | 3/1912 | Kaiserman | 160/297 |
| 1,019,654 | 3/1912 | Kaiserman | 160/297 |
| 1,132,830 | 3/1915 | Cole | 160/297 |
| 1,242,362 | 10/1917 | Moors | 160/297 X |
| 1,500,585 | 7/1924 | Hayslett | 160/297 |
| 1,758,961 | 5/1930 | Mendler | 160/297 |
| 2,025,239 | 12/1935 | Henning | 192/46 X |
| 2,614,629 | 10/1952 | Bleibtreu | 160/297 |

*Primary Examiner*—Rodney H. Bonck

*Attorney, Agent, or Firm*—Finnegan, Henderson, Farabow, Garrett & Dunner

[57] ABSTRACT

A shade roller latch comprises a latch member in a bore in a stationary stem. This latch member can fall by gravity into a notch in the inside circumferential surface of a shell rotatable with the shade roller to be received in part by this notch and lock the roller against rotation in relation to the stem.

5 Claims, 3 Drawing Figures

SHADE ROLLER LATCH

Figure 1:
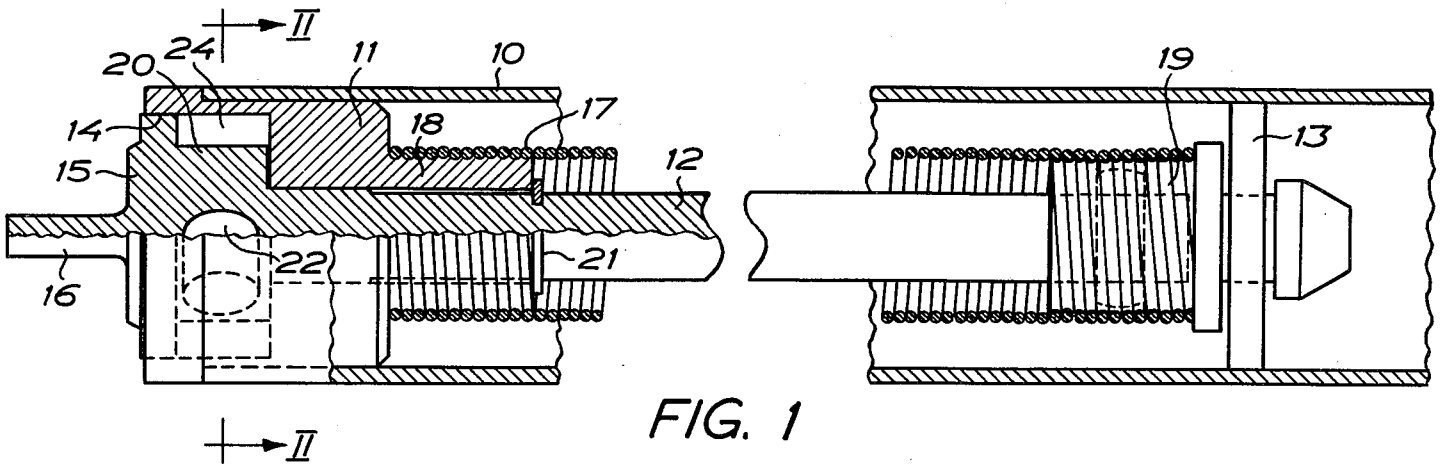

The invention relates to a latch for a shade roller comprising a tubular roller and a stem to be nonrotatably mounted, said stem being arranged coaxially in the roller, and further comprising a drive spring engaged between the roller and the stem.

The latch according to the invention is of the type including a cylindrical shell rotatable together with the roller, and a body arranged coaxially inside the shell for connection with the stem, and further including a movable latch member adapted to lock the shell and the body against relative rotation by engaging recesses in the shell and the body.

In existing latches of this type the latch member comprises one or more balls received by radial bores or other recesses in the shell and adapted to lockingly engage with bowl-shaped or semi-spherical recesses in the circumferential surface of the body forming part of the stem. Then, the balls can be received entirely by the bores or recesses in the shell when they are in disengaged position to allow rotation of the shell in relation to the stem, the balls being received in part by said bores or recesses and in part by the bowl-shaped recesses in the body when they are in engaged position. In order that the balls can be lockingly engaged with the body it is necessary that at least one of the bowl-shaped recesses in the body is located on the upper side thereof so that a ball can fall by gravity into said one recess.

A drawback of prior art latches of this type is that the stem is exposed to heavy strain at the bowl-shaped recesses in the circumferential surface of the stem and that said stem is exposed to substantial wear at these recesses particularly if the stem is made of plastics while the balls are made of metal. Another disadvantage is to be seen in the fact that it is difficult to arrange more than two locked positions for each revolution of the roller. When two or more shades are arranged one beside the other it is desired from a pure aesthetic point of view that these shades can be arrested exactly in one and the same position so that the lower edges thereof register, and this may be difficult to achieve if there are arranged two locked positions for each revolution only.

The object of the invention is primarily to eliminate these drawbacks of prior art latches of the type referred to above and also to provide a latch which includes few and relatively simple elements and which is of such construction that it is well suited to be connected as a separate unit to the roller and the stem, possibly by an automated assembling process.

Another object of the invention is to provide a latch that can operate with the stationary stem in several different rotational positions.

To achieve the foregoing objects and in accordance with the purpose of the invention, as embodied and broadly described herein, a latch for a shade roller of the type referred to above is characterized in that said body is located inside the shell and forms a bore extending on a diametrical line of the body to receive the latch member therein, and that the bore is arranged to allow movement of the latch member by gravity partly out of the bore to be in part received by a recess or one of a number of recesses in the inside circumferential surface of the shell, surrounding said body, for locking the body and the shell against relative rotational movement.

Figure 3:
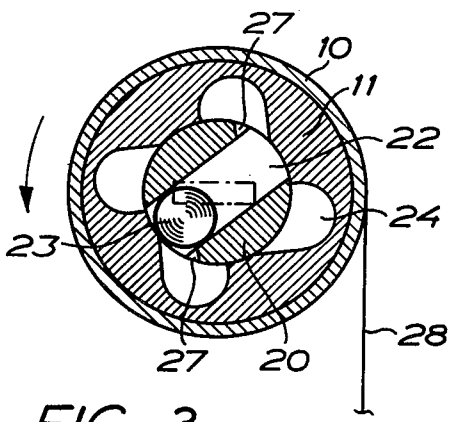
Figure 2:
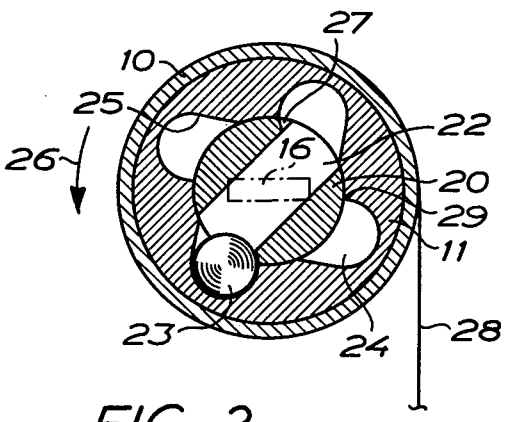

The invention will be described in more detail below reference being made to the accompanying drawing which illustrates a preferred embodiment of the invention and in which FIG. 1 is a side view, partly an axial sectional view, of one end portion of a shade roller provided with the latch according to the invention, FIG. 2 is a cross-sectional view along line II—II in FIG. 1, the latch being shown in engaged position, FIG. 3 is a cross-sectional view as that in FIG. 2, the latch being shown in disengaged position.

The shade roller in FIG. 1 comprises a tubular roller 10 on which the shade fabric is to be wound, and at the right end thereof not shown in the drawing this roller is provided with a pin for rotatable mounting of the shade roller in a supporting bracket in the conventional way, while the left end is connected to a cylindrical shell 11 e.g. by pressure fit such that the roller and the shell are rotatable as a unit. Preferably, the shell is made of plastics having good bearing properties and is rotatably mounted to a stem 12 which is rotatably mounted at the right end thereof in a washer 13 by means of which the stem is supported inside the roller. The other end of the stem is rotatably mounted in a cylindrical end cavity 14 in the shell 11 at a flange 15. This flange forms a pin 16 of rectangular cross-sectional form by means of which the stem is to be non-rotatably connected to a supporting bracket. The stem can be made of metal or plastics. A helical spring 17 is attached at one end thereof to the outside of a pin-like portion 18 of the shell 11 and is attached at the other end thereof to the outside of an attachment 19 connected to the stem 12. The shell 11 is positioned axially on the stem 12 between a head 20 formed by the stem and a lock ring 21 inserted into a groove in the stem.

When the roller is being rotated in one direction or the other by a shade fabric wound on the tubular roller being unwound therefrom the spring 17 will be tensioned by the rotation of the roller in relation to the stem and then the tensioned spring will drive the roller when the shade fabric is to be rewound on the roller again. The latch for locking the roller in a desired rotational position, the spring being tensioned more or less in such position with the shade fabric withdrawn more or less from the roller, is of a construction which is specific to the invention and will be described with reference also to FIGS. 2 and 3.

In the head 20 there is provided a through cylindrical bore 22 which forms an angle of 45° to the flat side of the pin 16. A metal ball 23 has such fit in the bore that it can move freely from one end of the bore to the other end thereof. The shell 11 encloses rotatably the head 20 and in the enclosing portion thereof four notches 24 are provided, said notches having a cylindrical curved bottom of substantially the same radius as the ball. The depth of the notches is substantially smaller than the diameter of the ball so that the ball cannot be entirely received by a notch. The notches are flared towards the mouth thereof by the side 25 of the notch, which is the rear side as seen in the rotational direction of the shell when the shell is driven by the spring—this rotational direction is indicated by an arrow 26 in FIGS. 2 and 3—being more inclined than the opposite side. A conical or spherical bevelling or chamfer 27 is arranged at each end of the bore at one side thereof as seen peripherally.

In order to lock the roller 10 against rotation under the bias of the spring 17 in the rotational direction indicated by the arrow 26 in FIG. 2 the ball 23 can roll by gravity into one of the notches 24 when said one notch registers with the lower mouth of the bore 22. However, only part of the ball can be received by the notch so that the ball accordingly will be received in part by the notch and in part by the bore. Consequently, the ball prevents rotation of the shell 11 and thus of the roller 10 in relation to the stem 12, the pressure exerted by the spring 17 on the ball 23 received by the notch 24, pressing the ball towards the chamfer 27. Thereby a component force directed towards the bottom of the notch is acting on the ball and by this component force the ball is forced against the bottom of the notch to secure a reliable locking without a heavy edge pressure being exerted on the mouth edge of the bore.

When it is desired to unlock the roller in order to unwind further the shade fabric from the roller or in order to rewind the shade fabric on the roller, the shade fabric indicated at 28 in FIGS. 2 and 3 is withdrawn against the bias of the spring 17 whereby the roller 10 and thus the shell 11 are rotated in clockwise direction, as seen in FIG. 2, the ball 23 being forced into the bore 22. By the shade fabric being pulled up or down relatively fast the shell 11 is rotated so fast that the ball will have no time to fall into the notches 24 passing the lower mouth of the bore 22. When the roller 10 is stopped by arresting the shade fabric it is easy to find, by allowing the roller to rotate a little in one direction or the other, a position wherein the ball 23 can fall into a notch and lock again the roller and the stem against relative rotation.

By each notch 24 being flared at 25 the ball 23 can more easily be forced into the bore 22 by the initial movement of the roller 10 when the shade fabric is being pulled in order to disengage the roller from the stem 12 and this movement can be further facilitated by the notch being bevelled or chamfered a little at the edge indicated at 29 in FIG. 2. Already when four notches are provided in the shell 11 as disclosed herein it is possible to finely control the adjustment of the shade fabric, but it is also possible to provide still more notches such as six or eight to make possible that the adjustment is performed in still smaller steps.

By arranging the bore 22 as shown herein the advantage is achieved that the shade roller can be mounted in the supporting brackets with the pin 16 lying horizontally or standing vertically because the bore 22 will always be inclined 45° and will have a mouth facing downwardly where the ball 23 can fall into one of the notches 24.

The main elements of the latch are the shell 11, the head 20 and the ball 23 and it is easy to construct these elements as a unit including also the flange 15 and the pin 16 and to arrange this unit for connection to the roller 10, the stem 11 and the spring 17 preferably by means of slide connections so that the mounting can easily be automated. The ball 23 can be replaced by a roller; the locking operation will be the same as that described above.

It will be apparent to those skilled in the art that various other modifications and variations could be made in the shade roller latch of the invention without departing from the scope and spirit of the invention.

I claim:

1. A latch for a shade roller having a tubular roller, a stem to be non-rotatably mounted, said stem being arranged coaxially in said roller, and a drive spring engaged between the roller and the stem, said latch comprising a cylindrical shell connected with the roller for rotation therewith, a body arranged coaxially with and surrounded by the shell and fixed to the stem, and a ball, the body having a through bore extending on a diametrical line transverse said body receiving said ball for free movement therein, and the shell having at least one recess in the inside circumferential surface thereof, said bore allowing movement of the ball partly out of each end thereof to be in part received by the recess for locking the body and the shell against relative rotational movement.

2. A latch according to claim 1 wherein the bore is inclined substantially 45° in the operative position of the stem.

3. A latch according to either claim 1 or 2 wherein the bore forms a chamfer at each end thereof, against which the ball can be forced under the bias of the spring.

4. A latch according to claim 3 wherein the chamfer is spherical or conical.

5. The latch of claim 1 wherein said shell has four recesses symmetrically radially spaced about its inside circumference.

* * * * *